United States Patent [19]

Melvin

[11] 4,119,937

[45] Oct. 10, 1978

[54] METAL BASE RESISTOR

[76] Inventor: Myron F. Melvin, 6767 Spring Brook N. Dr., Indianapolis, Ind. 46219

[21] Appl. No.: 739,557

[22] Filed: Nov. 8, 1976

[51] Int. Cl.[2] ..... H01C 1/012

[52] U.S. Cl. ..... 338/308; 338/271; 338/272; 338/276; 338/313; 338/324; 338/332; 427/102

[58] Field of Search ..... 338/308, 309, 306, 307, 338/30, 271, 272, 276, 312, 313, 322, 324, 332, 328, 329, 326, 333, 334; 29/621, 610, 619; 427/101-103, 123-126; 219/541

[56] References Cited

U.S. PATENT DOCUMENTS 2,216,375 10/1940 Minter ..... 338/332 X 3,872,419 3/1975 Groves et al. ..... 338/308 X

*Primary Examiner*—C. L. Albritton

*Attorney, Agent, or Firm*—Woodard, Weikart, Emhardt & Naughton

[57] ABSTRACT

A resistor, which can be of either the fixed or variable type, having a metal base covered by an insulating coating over all but an exposed area of the metal. A film type resistive compound or a wire winding covers the insulating coating but overruns it in the exposed area of the metal base and is bonded to the metal base. A suitable conventional terminal member is in conductive relation to the resistive compound covering at a point remote from the exposed area of the base so that the base, itself, may function as one terminal for the resistor.

9 Claims, 5 Drawing Figures

METAL BASE RESISTOR

BACKGROUND OF THE INVENTION

Variable resistors have been produced by the millions over a period of 50 years or more. Except for special types for particular applications, the design has usually consisted of a carbon powder mixture which has been printed, sprayed, or otherwise applied to an insulating base. The base normally used has been paper with a phenolic binder, providing adequate insulating properties for the carbon resistance track. A movable wiper has been the usual means of selecting the correct point on the track corresponding to the desired resistance. This wiper can be rotated by an affixed shaft or can be slotted or shaped to accept an actuator such as a screwdriver.

The paper base used as the insulation has two major deficiencies in that it is limited as to the temperature that it can withstand and it is subject to absorption of moisture. When moisture is absorbed, the bond between the base and the resistance track or coating is broken and the resistor becomes inoperable. The paper also lacks good mechanical strength and can be easily broken. One of the primary problems thus encountered with the use of phenolic based variable resistors has been that of unreliability. Normally the portions of the variable resistor at each end of the resistance track require that a transition be made from the resistance element to a metal terminal suitable for circuit soldering and mounting. The same difficulty sometimes exists in completing the circuit from the moveable wiper to the terminal. Unfortunately a solid bond cannot be made because the insulating base cannot withstand high temperature such as would be required with soldering, for example. When the heat of soldering a wire to the terminal, or when the terminal is dipped in a solder bath, the insulating material of the base can be damaged, loosening the mechanical fastening used to press the terminal against the carbon track. Even more likely, some of the resin used during the soldering operation may flow up the terminal and get between the terminal and the carbon film or coating.

Circuit designers, in their attempt to avoid failures, have weighed the costs of much higher quality designs versus the costs of product failure. In some cases an approach using a type of variable resistor built on a ceramic base has been selected, but this usually increases cost to about twice the cost of the phenolic base type. Obviously, in the quest for lower and lower costs, this selection cannot be tolerated permanently. The subject invention eliminates this problem without substantial cost increase.

An important difference in the structure embodying the present invention concerns the use of a metal as the base. The metal can be of a wide variety, selected for specific attributes. Steel would be the most usual selection, although brass, stainless steel, or various alloys could be used. A metal base has several advantage in addition to its obvious structural strength. Its moisture absorbence is non-existent, permitting a predicted stability, even under long storage periods at various temperatures. This ensures the preservation of the resistance track in its applied form. It also provides a remarkable improvement in power handling capability. In addition to the much higher operating temperatures that can be accommodated simply because the base is metal, the heat sink capabilities are important. No hot spot can develop and heat concentrated in a particular portion continuously dissipates by conduction into the reservoir formed by the remainder of the structure.

The feature of primary importance, however, of the present invention concerns the establishing of permanent continuity between the resistance track and the solder terminal. In order to insulate the resistance element or film from the metal base an insulating surface or coating must be applied. The metal base, preferably, has a tin plated surface to provide initial protection and solderability. This insulator coating could be a lacquer, a polyimid, such as DuPont's Pyre M-L, a tin-oxide, or if aluminum were used, an anodize. Other substances could be selected. In order to achieve the continuity desired, it is necessary to mask the portion of the metal base from the insulating coating, this portion becoming the terminal. The resistance film mix is then placed over the insulating coating and continued, in its application, past the insulated portion of the base into the exposed portion. The resistance material bonds to, or can be bonded by soldering to the base metal or its plated surface, for example, at the point of the base corresponding to the terminal. This terminal can be at any of the three common potentiometer positions and would have no mechanical joint, thus ensuring reliability.

DESCRIPTION OF THE PREFERRED EMBODIMENT

Figure 1:
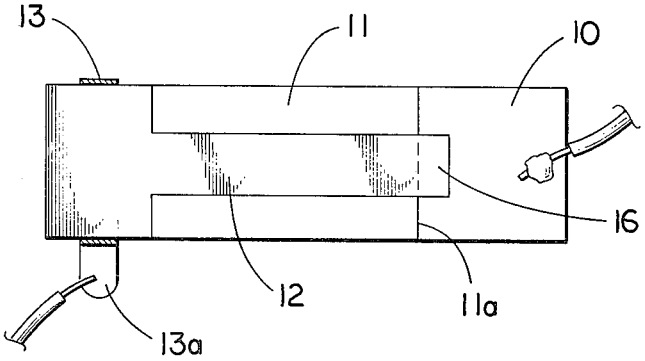
FIG. 1 is a top plan view of a resistor embodying the present invention.

Referring initially to FIG. 1 a metal base plate 10 has deposited on it an overlying electrical insulating coating 11, the coating terminating at the line **11*a* leaving the end portion of the metal plate 10 exposed. Deposited in overlying relation to the insulating coating 11 is a continuous resistive strip 12 which may be of the carbon film type. The resistive film 12 may encircle one end portion of the metal strip and a metal clamping band 13 may be made to grip this portion of the resistive film, the band having a tab 13*a* which may provide a terminal for suitable wiring. The resistive layer 12 overruns the insulating layer 11 so that the resistive film is directly applied to the exposed area of the metal base 10, this area of junction of the resistive film and the base being indicated at 16 in FIG. 1**.

This flat form of the resistor may be fabricated by the method and materials set out in the following example.

"EXAMPLE"

A steel plate approximately 1 inch by 3½ inches by 0.020 inches was dipped to about one inch from the top end so that the 2½ inches was coated on both sides with a commercial polyimide varnish (DuPont Pyre ML-RK-692, DuPont Co., Wilmington, Del. 19898) of approximately 18.5% solids.

The varnish was then dried and cured at about 100° C. for approximately one half hour. The insulating coating was determined to be 0.0005 inches thick.

Eight and 36/100 grams of the same varnish was weighed into a small container and 1.41 grams of graphite powder (Superior Graphite-3226, Superior Graphite Company, 20 North Wacker Drive, Chicago, Ill. 60606) was added and thoroughly mixed. The resultant pigment dispersion was such that the dried, cured film contained about 48% graphite. A rather heavy, wet film of the mix, approximately 0.010 inches to 0.012 inches thick, was applied to one side of the insulated steel strip. This film was approximately 0.4 inches wide and 2 inches long with 0.2 inches overlapping the uncoated part of the steel strip.

After drying and curing at 100° C. the resistance strip thus produced was about 0.007 inches thick and exhibited an electrical resistance of about 2000 ohms when measured from the uninsulated end of the steel strip to the opposite end of the graphic film containing strip. This assembly was than placed in the oven again at 200° C. for 30 minutes and its resistance after returning to room temperature was 700 ohms. This heating and measuring cycle was repeated until two successive readings were essentially the same. Final room temperature resistance was 250 ohms.

Figure 2:
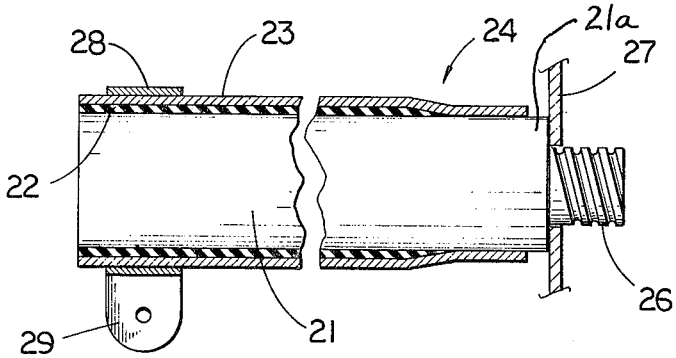
FIG. 2 is a side view, partially in section, of a modified form of the resistor.

Referring to FIG. 2, a modified form of the resistor is shown in which the base is a metal tube 21. Applied to the tube over all but one end portion thereof is an insulating coating 22. Applied over the insulating coating is a resistive film 23. The resistive film overruns the insulating coating 22 in the area indicated at 24 and extends into the exposed area 21*a* of the central tube providing electrical continuity between the resistive film and the metal tube 21. The closed end of the tube 21 carries an extending, threaded stud 26 which may be threaded through an aperture in a conventional metal control panel 27, thereby mounting the resistor on the panel and providing electrical continuity to the panel, the stud acting as a terminal of the resistor. At the opposite end of the resistor a clamp band 28, having a solder terminal 29 may be tightened around the tube 21, the inner surface of the band 28 making electrical contact with the resistance film layer 23, the tab 29 thus functioning as the other terminal of the resistor.

Figure 3:
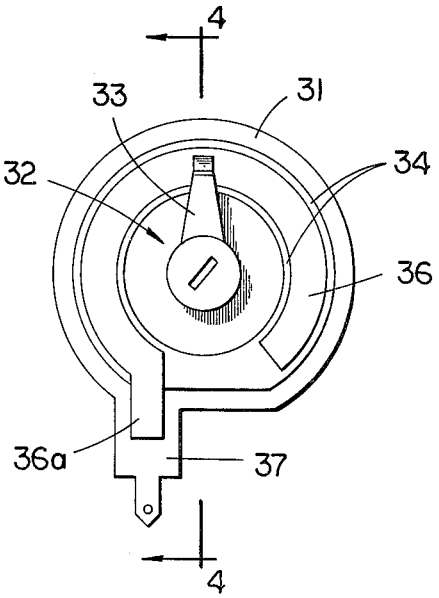
FIG. 3 is a top plan view of a further modification of the resistor.
Figure 4:
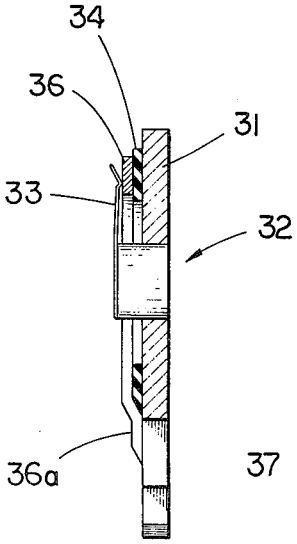
FIG. 4 is a sectional view taken generally along the line 4—4 of FIG. 3.

Referring to FIGS. 3 and 4, a further modified embodiment of the concept will be described. The resistor structure shown in FIGS. 3 and 4 is of the variable type and includes a generally disc-shaped metal base 31. The metal base has a central aperture through which extends a rotor structure indicated schematically at 32 and carrying a wiper arm 33. The rotor structure may be any one of the conventional types, the structure 32 here being shown schematically merely to illustrate that an arcuately moveable wiper arm may extend into electrical contact relation with the resistance film layer. An insulating layer, similar to the layer 22 of FIG. 2 and layer 11 of FIG. 1, is put down on the metal base in generally annular configuration, the insulator layer being identified at 34. Overlying the insulating layer 34 is a resistance film 36 which, as will be evident from FIG. 3, has an arcuate configuration and extends over the major portion of the annular insulating layer 34. The wiper arm 33 is adapted to contact and slide over the resistance film 36. The resistance film 36 is the counterpart of the resistance film or layer 23 of FIG. 2 and the layer 12 of FIG. 1.

A tab portion 37 extends integrally from the base 31 and a portion 36*a* of the resistance film overruns the insulating layer 34 and is bonded electrically to the exposed, underlying metal tab 37. The tab 37 thus functions as one terminal of the variable resistor, the other terminal (not shown) may be formed by suitable conventional electrical connection to the wiper arm 33 or to a common junction between the wiper arm 33 and the end of the resistance layer 36 opposite the portion 36*a*.

Figure 5:
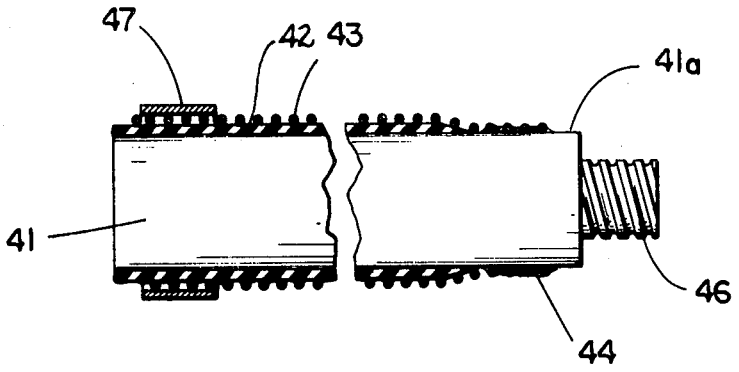
FIG. 5 is a side view, partially in section, of a further modified form of the resistor.

FIG. 5 illustrates a wire wound adaptation of the resistor of FIG. 2. In FIG. 5, the tube 41 is provided with an electrically insulating layer 42, the counterpart of the layer 23 of FIG. 2, which extends for substantially the entire length of the tube except for an exposed end portion of the tube indicated at 41*a*. At the end 41*a* of the tube the winding 43 overruns the insulating layer 42 and may be soldered, as indicated at 44, to the exposed end of the metal tube 41 or may be clamped thereto so that the winding has electrical continuity with the metal tube. The tube 41 may be provided with a threaded stud 46 for mounting to a panel, the stud serving to provide one terminal of the resistor. The other end of the winding 43 is provided with an encircling metal clamp 47, which is the counterpart of the clamp 28 of FIG. 2, having electrical continuity with the end of the resistance winding 43 and providing the opposite terminal for the resistor.

It will be understood that the structure of FIG. 3 might be modified so as to have either a right or left hand terminal. The concept is applicable to slide or linear motion types of variable resistors. On-off switching can be incorporated by masking selected positions along the resistance film track. The structure of FIG. 3 minus the wiper arm component may also be utilized in a double plate design in which a second disc-shaped plate overlies the base 31 and is insulated from it and acts as a pick-off terminal.

While the invention has been disclosed and described in some detail in the drawings and foregoing description, they are to be considered as illustrative and not restrictive in character, as other modifications within the scope of the invention may readily suggest themselves to persons skilled in the art.

I claim:

1. A film type resistor comprising a metal base, an electrically insulating coating overlying all but a predetermined exposed portion of the metal base, a continuous resistive film deposited in overlying relation to said insulating coating, said film overrunning said insulating coating only at said exposed portion of said metal base and being conductively bonded thereto, and a terminal element remote from said base-bonded portion of the film having electrical contact therewith, whereby said base and said terminal element function as terminals for the resistor.

2. A film type resistor as claimed in claim 1 in which said metal base takes the form of an elongated metal rod with said exposed portion disposed at one end thereof and said terminal element adjacent the opposite end of said rod.

3. A film type resistor as claimed in claim 2 in which one end of said metal rod is adapted to mount said resistor on a panel.

4. A film type resistor as claimed in claim 2 in which said insulating coating covers all of said metal rod except the marginal area at one of its ends, this area forming said exposed portion.

5. A film type resistor as claimed in claim 1 in which said metal base is generally disc-shaped and said resistive film is disposed in a generally flat circular configuration, the center of said base being adapted to receive a wiper arm engaging said resistive film.

6. A film type resistor as claimed in claim 5 in which an integral tab extends outwardly from said disc-shaped base and forms said exposed portion of the metal base.

7. A film type resistor as claimed in claim 1 in which said metal base is generally disc-shaped and said insulating coating is disposed in a generally annular configuration thereon, said resistive film overlying an arcuate portion of said insulating coating.

8. A film type resistor as claimed in claim 7 in which an integral tab extends outwardly from said disc-shaped base and forms said exposed portion of the metal base, and in which said resistive film overruns said insulating coating and extends onto said tab.

9. A resistor comprising a metal base, an electrically insulating coating overlying all but a predetermined exposed portion of the metal base, a continuous resistive conductor disposed in overlying relation to said insulating coating, said conductor overrunning said insulating coating only at said exposed portion of said metal base and being conductively bonded thereto, and a terminal element remote from said base-bonded portion of said conductor having electrical contact with said conductor, whereby said base and said terminal element function as terminals for the resistor.

* * * * *